US006250267B1

(12) United States Patent
Methley

(10) Patent No.: US 6,250,267 B1
(45) Date of Patent: Jun. 26, 2001

(54) ROLLING ELEMENT PHASER

(75) Inventor: Ian Methley, Witney (GB)

(73) Assignee: Mechadyne PLC, Kirtlington (GB)

( * ) Notice: Subject to any disclaimer, the term of this patent is extended or adjusted under 35 U.S.C. 154(b) by 0 days.

(21) Appl. No.: 09/507,095

(22) Filed: Feb. 17, 2000

(30) Foreign Application Priority Data

Feb. 18, 1999 (GB) ..... 9903621

(51) Int. Cl.[7] ..... F01L 1/344

(52) U.S. Cl. ..... 123/90.17; 74/568 R; 464/2; 464/160

(58) Field of Search ..... 123/90.15, 90.17, 123/90.31; 74/568 R; 464/1, 2, 160, 161

(56) References Cited

U.S. PATENT DOCUMENTS 3,807,243 * 4/1974 Yada ..... 74/63
5,078,647 * 1/1992 Hampton ..... 464/1
5,172,661 * 12/1992 Brune et al. ..... 123/90.17
5,172,662 * 12/1992 Hampton ..... 123/90.17
5,219,313 * 6/1993 Danieli ..... 464/2
5,803,030 * 9/1998 Cole ..... 123/90.17

* cited by examiner

*Primary Examiner*—Weilun Lo
(74) *Attorney, Agent, or Firm*—Smith-Hill and Bedell

(57) ABSTRACT

A variable phase coupling 10 is disclosed for connecting a crankshaft of an engine to a camshaft 16. The coupling 10 comprises a drive member 14, 18 having a first set of grooves 20, a driven member 26 having a second set of grooves 28 and mounted in a fixed axial position relative to the drive member 18 and an intermediate member 30 movable axially in relation to the drive and driven members. Grooves are arranged on the same side of the intermediate member to face the grooves of both the drive member and the driven member. A first set of balls 36 is engaged in the grooves 20 of the drive member 18 and the intermediate member 30 and a second set of balls 34 is engaged in the grooves 28 of the driven member 26 and the intermediate member 30 so as to transmit torque from the drive member to the driven member through the intermediate member. At least some of the grooves are helical grooves so that the relative phase of the drive and driven members varies in dependence of the axial position of the intermediate member 30.

3 Claims, 4 Drawing Sheets

ROLLING ELEMENT PHASER

FIELD OF THE INVENTION

The present invention relates to a variable phase coupling for allowing the phase of a drive member and a driven member to be changed in relation to one another. The invention is particularly applicable to a coupling for varying the phase of a camshaft in relation to the crankshaft of an internal combustion engine.

BACKGROUND OF THE INVENTION

The optimum angles at which the inlet and exhaust valves of an internal combustion engine should open and close, both in relation to one another and in relation to the engine crankshaft, vary with the engine speed and load conditions. In an engine with a fixed valve timing, a compromise setting must be adopted in which different performance parameters are traded off one against the other.

To achieve improved performance over a range of engine speeds and loads, it has already been proposed to use a variable phase coupling to vary the phase of a camshaft in relation to the crankshaft and in relation to another camshaft.

Several variable phase couplings are known from the prior art, each having its own advantages and disadvantages. Noise and wear are particularly serious common problems that are caused by the fact that camshafts are subjected to torque reversal during operation. While a valve is being opened by a cam on the camshaft, torque has to be applied to the camshaft in one direction to overcome the resistance of the valve spring. On the other hand, while a valve is closing, its spring attempts to accelerate the camshaft and the camshaft experiences a torque reaction from the valve train acting in the opposite direction.

To suppress the noise resulting from torque reversals, it is necessary either to make the couplings very accurately or to employ some form of active backlash control. Such active backlash control conventionally contributes to an increase in sliding friction and increases the force required to bring about a change in phase. As a result, it is necessary to resort to a larger actuator and, if a hydraulic actuator is used, this also means a slower response because of the small diameter of the drillings in the camshaft that feed oil to the actuator.

A further problem with some known designs is that they cannot be retrofitted to an existing engine because they require major modification to the engine block, cylinder head or valve train.

With a view to mitigating the above problems, a variable phase coupling has already been proposed in the Applicants' co-pending International Patent Application PCT/GB98/02153, now WO 99/06675, published on Feb. 11, 1999, to provide which comprises a drive member for connection to the crankshaft having grooves of a first pitch, a driven member for connection to the engine camshaft having helical grooves of a different pitch facing towards the grooves in the drive member, balls engaged in the two helical grooves and serving to couple the drive and driven members for rotation with one another, an intermediate member disposed between the drive and driven members in contact with the balls, and means for displacing the intermediate member relative to the drive and driven members, the displacement of the intermediate member serving to move the balls relative to the helical grooves in the drive and driven members so as to vary the phase between the drive and driven members. In the latter co-pending patent application, the intermediate member has grooves on its inner and outer surfaces and two sets of balls are provided, the first set engaging in the pairs of helical grooves comprising the helical grooves in the driven member and the facing grooves on one surface of the intermediate member and the second set of balls engaging in the pairs of helical grooves that comprise the grooves in the drive member and the facing grooves on the other surface of the intermediate member.

The drive, driven and intermediate members in the latter proposal thus lie radially one inside the other thereby requiring the coupling to have a relatively large diameter. This can create packaging difficulties when there is insufficient space to accommodate a coupling of a large diameter.

OBJECT OF THE INVENTION

The present invention seeks therefore to provide a variant of the coupling of the Applicants' earlier proposal which is more suitable for engines in which the radial space available to accommodate the variable phase coupling is restricted.

SUMMARY OF THE INVENTION

According to the present invention, there is provided a variable phase coupling for connecting a crankshaft of an engine to a camshaft, the coupling comprising a drive member having a first set of grooves, a driven member having a second set of grooves and mounted in a fixed axial position relative to the drive member, an intermediate member movable axially in relation to the drive and driven members, grooves arranged on the same side of the intermediate member to face the grooves of both the drive member and the driven member, a first set of balls engaged in the grooves of the drive member and the intermediate member and a second set of balls engaged in the grooves of the driven member and the intermediate member so as to transmit torque from the drive member to the driven member through the intermediate member, at least some of the grooves being helical grooves whereby the relative phase of the drive and driven members varies in dependence of the axial position of the intermediate member, wherein a cage is provided between the intermediate member and the drive and driven members to retain the balls in relation to one another, and wherein at least one of the grooves in each of the drive and driven members has a slightly different pitch from the corresponding groove in the intermediate member and means are provided for resiliently urging the drive and driven members axially relative to one another.

The invention differs from the Applicants' earlier proposal in that centres of the balls of the two sets can lie on circles of the same diameter that are axially offset from one another instead of being one inside the other. This allows a coupling to be made of a smaller diameter though the axial length of the coupling will at the same time be greater.

As with the earlier proposed coupling, because of the torque reversals to which the coupling is subjected during operation, it is important to take steps to eliminate backlash. This is achieved in the first aspect of the invention by suitable choice of the pitch of the different grooves. Thus, by forming one of the grooves in a set with slightly different pitch angle from the others the balls have a defined axial position. Biasing of the ball in the axial direction will then ensure that the balls remain firmly in contact with the tracks.

BRIEF DESCRIPTION OF THE DRAWINGS

The invention will now be described further, by way of example, with reference to the accompanying drawings, in which.

DETAILED DESCRIPTION OF THE PREFERRED EMBODIMENTS

Figure 1:
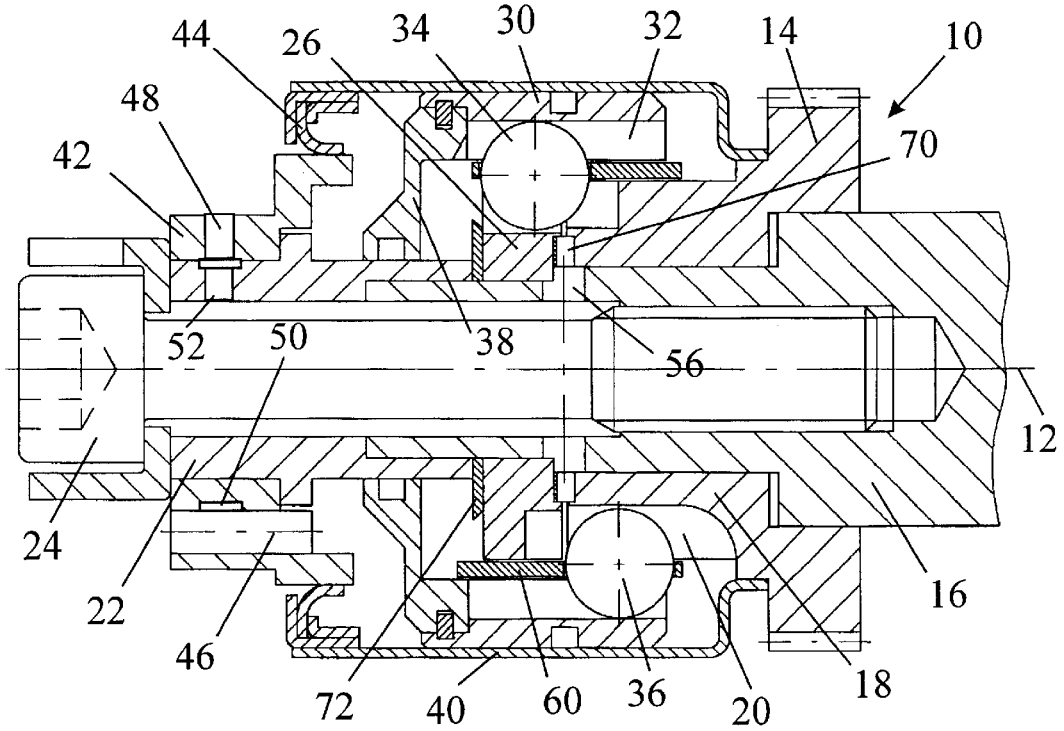
FIG. 1 is a longitudinal section through a coupling of the invention in the plane containing the axis of rotation of the coupling, the Figure showing the intermediate member positioned in the middle of its range of adjustment.

FIG. 1 shows a section through a variable phase coupling 10 of the invention passing through the axis of rotation 12 of the coupling. The coupling comprises a drive member which in the illustrated embodiment is a gear 14 driven by an engine crankshaft and the driven member constituted by a camshaft 16 that is only partly shown in the drawings.

Figure 2:
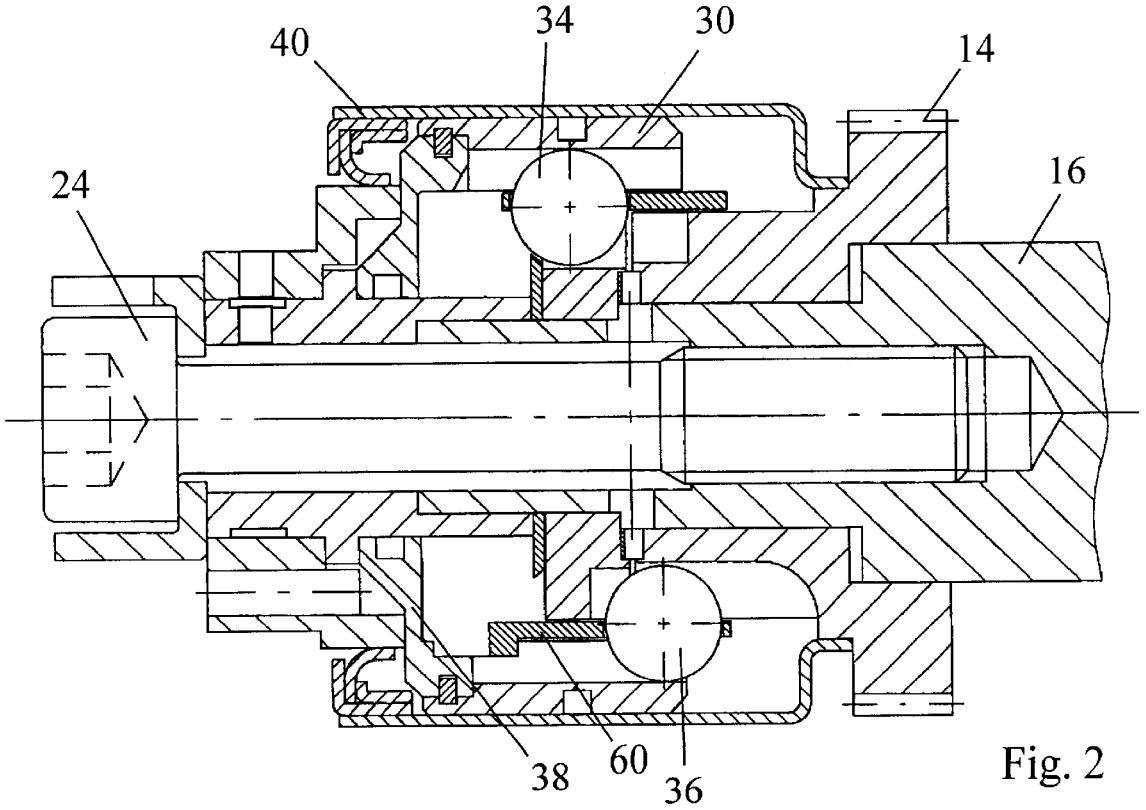
FIG. 2 is a similar section through the coupling of FIG. 1 showing the intermediate member at one of the two end positions of its range of adjustment.
Figure 4:
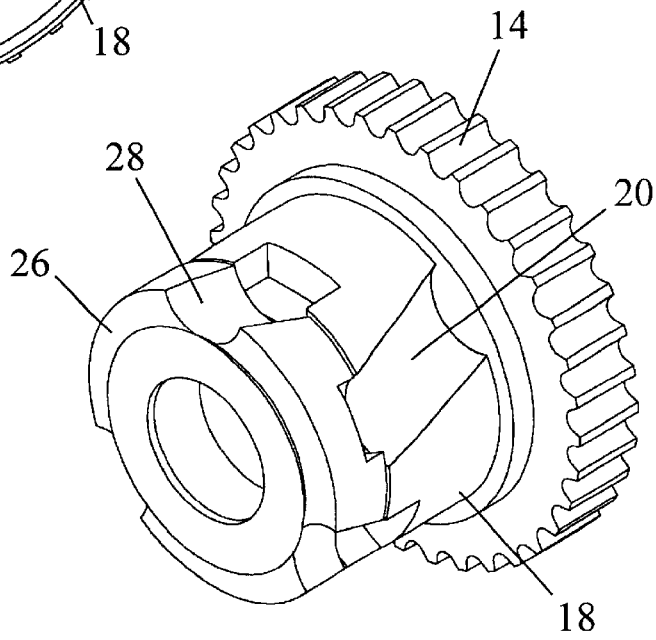
FIG. 4 is a perspective view of the drive and driven members.
Figure 5:
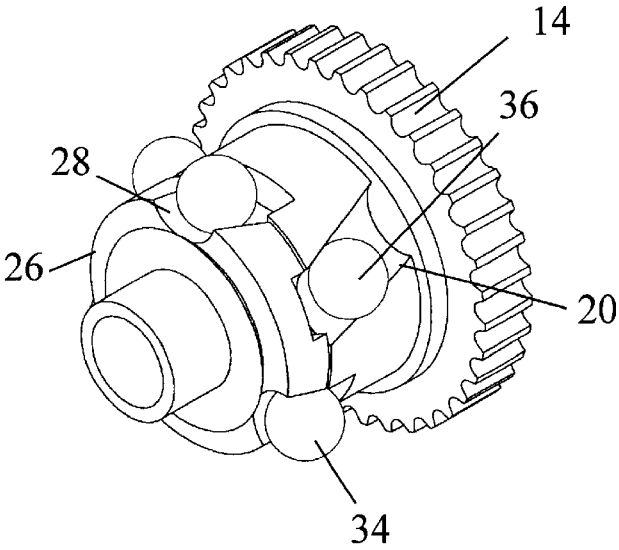
FIG. 5 is a view similar to that of FIG. 3 showing the balls positioned in the grooves.

The gear 14 is rotatably mounted on the camshaft 16 and is formed integrally with a ball race 18 (see FIG. 2) having external helical grooves 20. An annular sleeve 22 is secured by means of a bolt 24 to the end of the camshaft 16 and rotates with the camshaft. A second ball race 26 (see FIG. 4) having helical grooves 28 is held captive between shoulders on the camshaft 16 and the sleeve 22 and rotates in unison with the camshaft.

Figure 7:
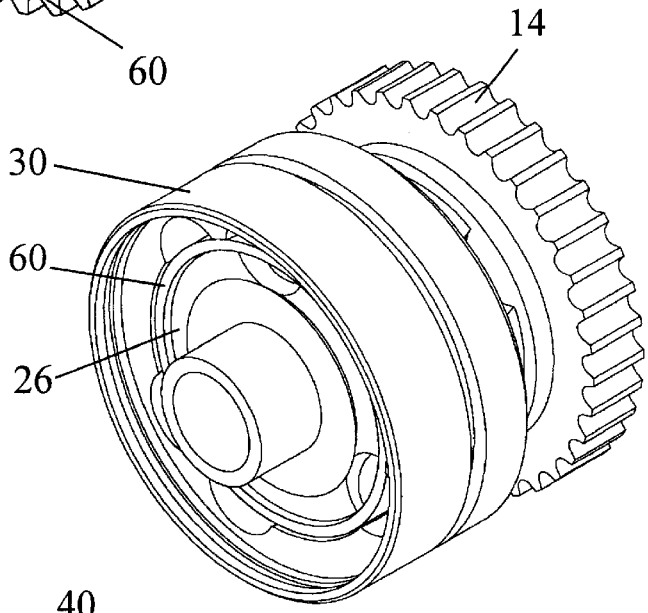
FIG. 7 is a view similar to that of FIG. 6 showing the intermediate member fitted over the balls and the cage.
Figure 8:
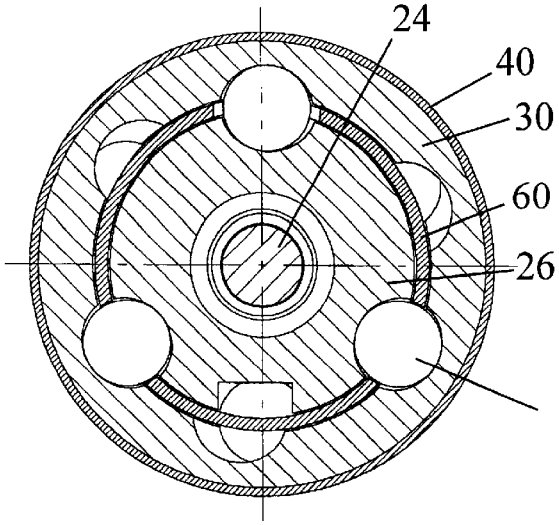
FIG. 8 is a section through the coupling in a plane normal to the axis of rotation.

An intermediate member 30 (see FIG. 7) having internal helical grooves 32 surrounds the two inner ball races 18 and 26 and is coupled for rotation with the two inner ball races by means of two sets of balls 34, 36. The intermediate member 30 is movable hydraulically in an axial direction relative to the two races 18 and 26 in that it is connected to a piston 38 reciprocable within a working chamber contained within a cylinder 40 that rotates with the drive member and is sealed by means of a rotary seal 44 at its other end relative to a stationary support collar 42 that forms part of the engine cylinder head. An axially extending passage 46 is formed in the support collar 42 to allow oil to flow to the left hand side of the piston 38, as viewed whereas oil reaches the right hand side of the piston through a radial passage 48 in the collar 42, an annular recess 50 and radial bores 52 in the annular sleeve 22, the annular space 54 between the bolt 24 and the sleeve 22 and openings 56 in the camshaft 16.

Figure 3:
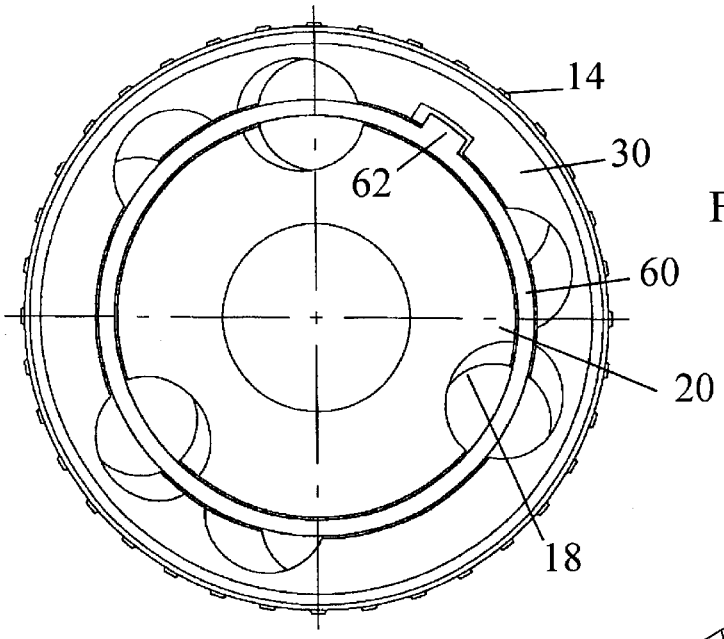
FIG. 3 is an end view of the coupling.
Figure 6:
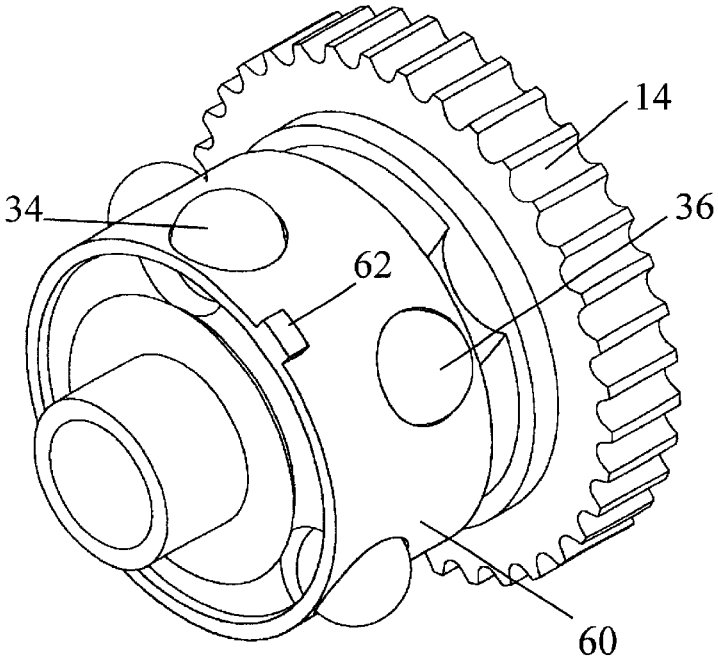
FIG. 6 is a view similar to that of FIG. 5 showing the cage fitted over the balls.

The two sets of balls 34, 36 are received in a cage 60 (see FIG. 6) arranged between the intermediate member 30 and the inner ball races, the cage being retained axially by means of an upturned tongue 62 (see FIG. 3) that engages in a recess in the end of the intermediate member 30.

A corrugated spring 70 is arranged between the two inner ball races 18 and 26 to urge them apart and a washer 72 is arranged between the annular sleeve 22 and the ball race 26 to prevent the balls 34 from moving out of their helical grooves.

The phase of the gear 14 is adjusted in relation to the camshaft 16 by axial displacement of the intermediate member relative to the two inner races 18 and 26. Because of the different pitches of the helical grooves 20 and 28 and the corresponding grooves in the inner surface of the intermediate member, which serves as an outer ball race, axial displacement of the intermediate member will act to rotate the inner ball races relative to one another and thereby vary the phase of the drive member relative to the driven member.

It is important in any mechanism driving a camshaft to eliminate backlash because the reversals of the torque transmitted through the coupling would result in severe noise and wear. In the described variable phase coupling, various means can be employed to eliminate backlash.

Figure 9:
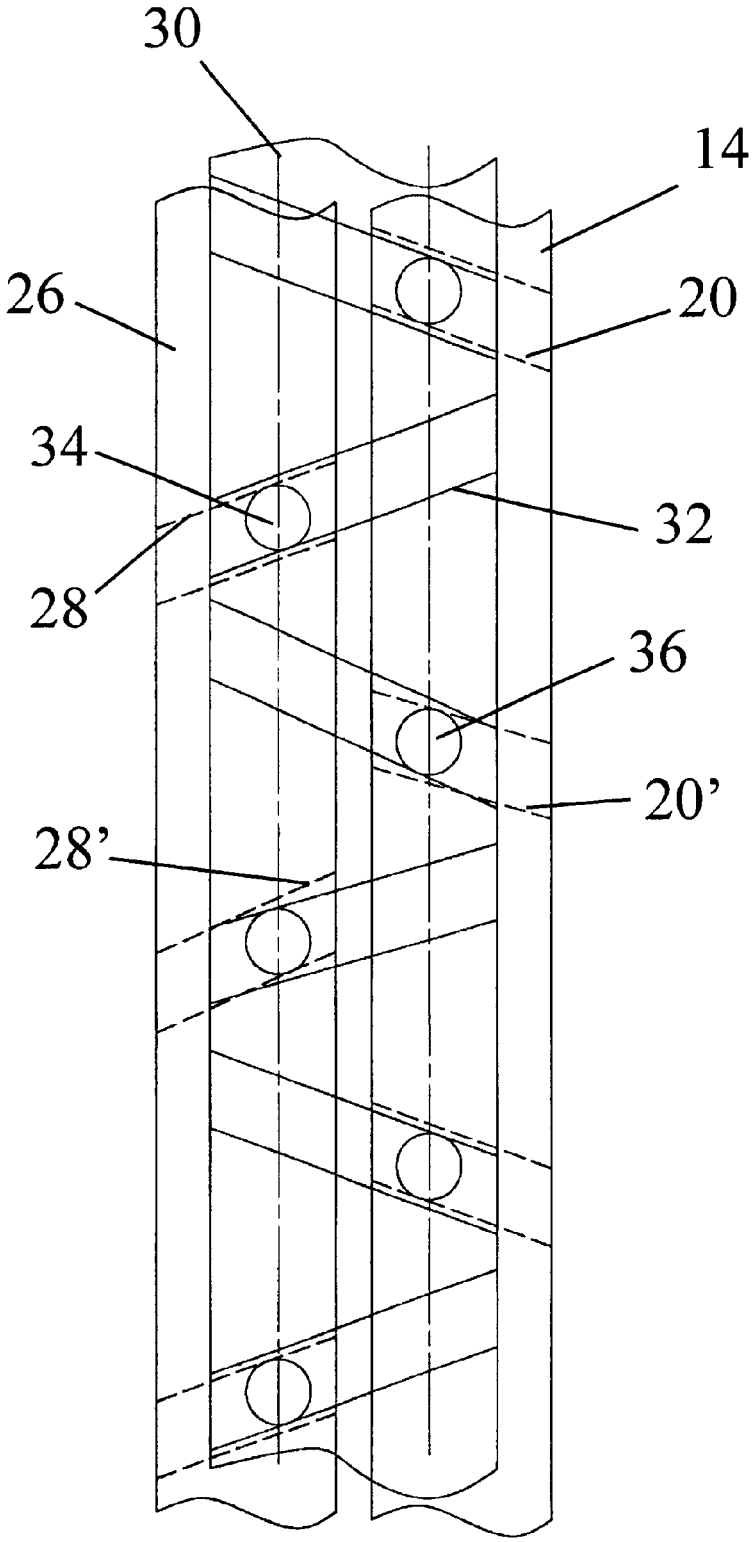
FIG. 9 is a projection of the races onto a flat serving to illustrate one method of eliminating backlash.

One possibility, illustrated in FIG. 9, is to provide one helical groove 20', 28' on each race 18, 26 that has a slightly different pitch from the corresponding groove 32 in the intermediate member 30. By holding the balls in a cage and resiliently urging the races axially apart or by resiliently biasing the drive and driven members apart, it is possible to take up any backlash.

Another possibility is to form the helical grooves in one race with a slightly different pitch from the grooves in the other race and to position two balls within each pair of grooves that are spring biased apart to eliminate backlash.

A further possibility is to form the intermediate member as a radially flexible cup whereupon backlash can be eliminated by radial clamping of the balls between the intermediate member and the ball races.

What is claimed is:

1. A variable phase coupling for connecting a crankshaft of an engine to a camshaft, the coupling comprising a drive member having a first set of grooves, a driven member having a second set of grooves and mounted in a fixed axial position relative to the drive member, an intermediate member movable axially in relation to the drive and driven members, grooves arranged on the same side of the intermediate member to face the grooves of both the drive member and the driven member, a first set of balls engaged in the grooves of the drive member and the intermediate member and a second set of balls engaged in the grooves of the driven member and the intermediate member so as to transmit torque from the drive member to the driven member through the intermediate member, at least some of the grooves being helical grooves whereby the relative phase of the drive and driven members varies in dependence of the axial position of the intermediate member, wherein a cage is provided between the intermediate member and the drive and driven members to retain the balls in relation to one another, and wherein at least one of the grooves in each of the drive and driven members has a slightly different pitch from the corresponding groove in the intermediate member and means are provided for resiliently urging the drive and driven members axially relative to one another.

2. A variable phase coupling as claimed claim 1, wherein the outer surface of the intermediate member serves as one of the sealing surfaces of a hydraulic actuation system of the variable phase coupling.

3. A variable phase coupling for connecting a crankshaft of an engine to a camshaft, the coupling comprising a drive member having a first set of grooves, a driven member having a second set of grooves and mounted in a fixed axial position relative to the drive member, an intermediate member movable axially in relation to the drive and driven members, grooves arranged on the same side of the intermediate member to face the grooves of both the drive member and the driven member, a first set of balls engaged in the grooves of the drive member and the intermediate member and a second set of balls engaged in the grooves of the driven member and the intermediate member so as to transmit torque from the drive member to the driven member through the intermediate member, at least some of the grooves being helical grooves whereby the relative phase of the drive and driven members varies in dependence of the axial position of the intermediate member, wherein a cage is provided between the intermediate member and the drive and driven members to retain the balls in relation to one another, and wherein at least one of the grooves in one of the drive and driven members has a pitch that differs from the pitch of the corresponding groove in the intermediate member, and means are provided for resiliently urging the drive and driven members axially relative to one another in order to remove backlash from the variable phase coupling.

* * * * *